US012751583B2

(12) United States Patent
Liu

(10) Patent No.: US 12,751,583 B2
(45) Date of Patent: Oct. 6, 2026

(54) BATH CHAIR

(71) Applicant: Xinzhiyuan Medical Equipment (Guangdong) Co., Ltd., Foshan (CN)

(72) Inventor: Zhongliang Liu, Foshan (CN)

( * ) Notice: Subject to any disclaimer, the term of this patent is extended or adjusted under 35 U.S.C. 154(b) by 85 days.

(21) Appl. No.: 18/984,045

(22) Filed: Dec. 17, 2024

(65) Prior Publication Data

US 2026/0102028 A1 Apr. 16, 2026

(30) Foreign Application Priority Data

Oct. 15, 2024 (CN) ..... 202422493227.6
Oct. 15, 2024 (CN) ..... 202422493232.7

(51) Int. Cl.
*A47K 3/12* (2006.01)
*A47C 3/40* (2006.01)
*A47C 7/54* (2006.01)

(52) U.S. Cl.
CPC ..... *A47K 3/122* (2013.01); *A47C 3/40* (2013.01); *A47C 7/541* (2018.08)

(58) Field of Classification Search
CPC ..... A47K 3/122; A47C 3/40; A47C 7/541
See application file for complete search history.

(56) References Cited

U.S. PATENT DOCUMENTS 12,490,868 B2 * 12/2025 Mao ..... A47K 3/122
2020/0085243 A1 * 3/2020 Lin ..... A61G 5/1072
2022/0117445 A1 * 4/2022 Lin ..... A47K 3/122
2025/0107669 A1 * 4/2025 Zhang ..... A47K 3/122

* cited by examiner

*Primary Examiner* — Christine J Skubinna

(57) ABSTRACT

A bath chair, comprising support frames, a sliding component, and a seat component; the seat component is mounted on the rotating component, the rotating component is mounted on the sliding component, the sliding component is mounted on the support frame, the seat component and the rotating component are moved left and right on the support frame through the sliding component, and the seat component is rotated through the rotating component. The beneficial effects of the invention are that the invention has a reasonable structure, has the functions of realizing the height adjustment of the seat component, the width adjustment of the armrest, the left and right movement adjustment and the rotation adjustment of the seat component, has good stability, is easy to operate and use.

12 Claims, 9 Drawing Sheets

BATH CHAIR

TECHNICAL FIELD

The invention relates to the technical field of bath chairs, and in particular to a bath chair.

BACKGROUND ART

The elderly, patients, children and other special groups have difficulty taking a bath independently due to their limited mobility or lack of self-care ability. They need assistance during the bathing process. In order to solve this problem, some equipment to assist special groups in taking a bath has emerged. Bathing chairs are one of them. During the bathing process, special groups sit on the bathing chairs, and the caregivers assist them in bathing.

However, when currently used in bathing chairs, the seats are mostly fixed, and it is difficult to adjust the position and orientation of the bathing chair according to actual conditions, which makes it inconvenient to use.

SUMMARY OF THE INVENTION

The technical problem to be solved by the invention is to overcome the defects of the above technology and provide a bath chair.

A bath chair, comprising:

support frames which comprise support crossbars;

a sliding component which comprises sliding frames and sleeve pieces arranged on the sliding frames, and the sleeve pieces are sleeved on the support crossbars of the support frames;

a seat component, which moves on the support frames via the sliding component.

Further, both ends of the support crossbar on the support frame are provided with height adjustment devices.

Further, the sliding component further comprises a locking latch, a locking guide block, and a locking pusher; the locking guide block is connected to an outer wall of the sleeve piece, and a middle of the locking guide block is provided with a locking guide hole; the locking latch can pass through the locking guide hole and the sleeve piece and be inserted into the support crossbar, and the locking pusher is connected to the locking latch.

Further, the seat component comprises a seat plate, a backrest, seat frame tubes, and armrests; the seat frame tubes are arranged at a bottom of the seat plate, and the armrests are arranged on both sides of the seat plate and mounted on the seat frame tubes; the seat frame tubes are arranged on the sliding component.

Further, the bath chair further comprises a rotating component provided between the sliding component and the seat component, and the rotating component comprises a first rotating disk, a second rotating disk, and a plurality of rotating balls; the first rotating disk is connected to the sliding frames, and the second rotating disk is connected to the seat component; an upper surface of the first rotating disk and a lower surface of the second rotating disk are both provided with ball grooves, and a plurality of the rotating balls are arranged in the ball grooves; the first rotating disk and the second rotating disk rotate relative to each other via the rotating balls.

Further, the rotating component further comprises a locking seat, a locking handle, a locking column, and a locking elastic piece; the locking seat is connected to the seat component, and the locking handle is connected to the locking seat in an up-and-down rotational manner; the first rotating disk is provided with a plurality of first locking positioning holes, and the plurality of first locking positioning holes are distributed at intervals along the circumference of the first rotating disk; the second rotating disk is provided with a second locking positioning hole; the locking handle is connected to the locking column; one end of the locking elastic piece is connected to the locking seat, and the other end thereof is used to drive the locking handle to rotate, so as to drive the locking column to pass through the second locking positioning hole and be inserted into one of the first locking positioning holes.

Further, the seat tube frame comprises a first seat tube and a second seat tube; both ends of the first seat tube are provided with fixing sleeves, and both ends of the second seat tube are provided with rotatable rotating sleeves; one end of the armrest is connected to the rotating sleeve, and the other end thereof is detachably connected to the fixing sleeve; a lower part of the rotating sleeve is provided with a limiting hole, and the second seat tube is provided with a limiting column passing through the limiting hole.

Further, a locking buckle, a locking piece, and an elastic piece are provided between the armrest, the first seat tube, and the fixing sleeve; the locking piece is inserted into the first seat tube along the axial direction of the first seat tube and is movably connected to the first seat tube via the elastic piece; the locking piece is provided with a locking hole, and an inner diameter of the locking hole gradually decreases along the axial direction of the first seat tube;

the locking buckle is arranged at a bottom of the connection end between the armrest and the fixing sleeve, and the locking buckle can pass through a large inner diameter end of the locking hole and be clamped to a small inner diameter end of the locking hole.

Further, the sleeve piece is tubular, with sliding sleeves provided at both ends, and a sliding protrusion is provided inside the sliding sleeve.

Further, the number of the support crossbars is two and they are parallel to each other; both ends of each support crossbar are connected to telescopic pieces through support elbows so that the height can be adjusted according to the height of the user; a bottom end of the telescopic piece is provided with a supporting foot pad.

Further, both ends of the first seat tube and the second seat tube adopt telescopic piece structures to achieve a telescopic design, so as to facilitate different users.

Further, the telescopic piece comprises an inner tube and an outer tube, and an elastic adjustment piece is provided between the inner tube and the outer tube; the outer tube is provided with a plurality of adjustment holes.

Further, the locking hole is in a water drop shape; the locking buckle is provided with a locking groove, and the locking groove is clamped to an end of the locking hole close to the seat plate.

The beneficial effects of the invention are that the invention has a reasonable structure, has the functions of realizing the height adjustment of the seat component, the width adjustment of the armrest, the left and right movement adjustment and the rotation adjustment of the seat component, has good stability, is easy to operate and use, and specifically:

1. In the bath chair provided by the invention, the seat component is connected to the support frame through a sliding component, so that the horizontal position of the seat component can be adjusted left and right. The user can adjust the position of the bath chair according to actual conditions, which is more convenient to use.

2. In the bath chair provided by the invention, the seat component is connected to the sliding frame through a rotating component, so that the function of adjusting the direction of the seat component can be realized. The user can adjust the direction of the bath chair according to actual conditions, which is more convenient to use.
3. Between the two armrests provided by the invention, the first seat tube and the second seat tube both adopt telescopic pieces, so that the width adjustment in the left and right directions can be achieved.
4. One end of the armrest of the invention is rotatably connected to the second seat tube through a rotating sleeve, and the other end thereof is detachably connected to the fixing sleeve, so that the armrest can be opened and turned over.
5. The support frame of the invention has telescopic pieces at both ends to achieve height adjustment of the seat component.

As shown in the figures: 1 refers to the support frame; 2 refers to the sliding component; 3 refers to the seat component; 4 refers to the rotating component; 5 refers to the rotating sleeve; 6 refers to the fixing sleeve; 7 refers to the limiting column; 8 refers to the locking buckle; 9 refers to the locking piece; 10 refers to the elastic piece; 11 refers to the support crossbar; 12 refers to the support elbow; 13 refers to the supporting foot pad; 21 refers to the sliding frame; 22 refers to the sleeve piece; 23 refers to the locking latch; 24 refers to the locking guide block; 25 refers to the locking pusher; 31 refers to the seat plate; 32 refers to the backrest; 33 refers to the seat frame tube; 34 refers to the armrest; 41 refers to the first rotating disk; 42 refers to the second rotating disk; 43 refers to the locking seat; 44 refers to the locking handle; 45 refers to the locking column; 51 refers to the limiting hole; 81 refers to the locking groove; 91 refers to the locking hole; 331 refers to the first seat tube; 332 refers to the second seat tube; 411 refers to the first locking positioning hole; 421 refers to the second locking positioning hole; 431 refers to the accommodating groove; 101 refers to the elastic adjustment piece; 102 refers to the adjustment hole.

SPECIFIC EMBODIMENT OF THE INVENTION

The invention will be further described in detail hereinafter with reference to the drawings.

Figure 1:
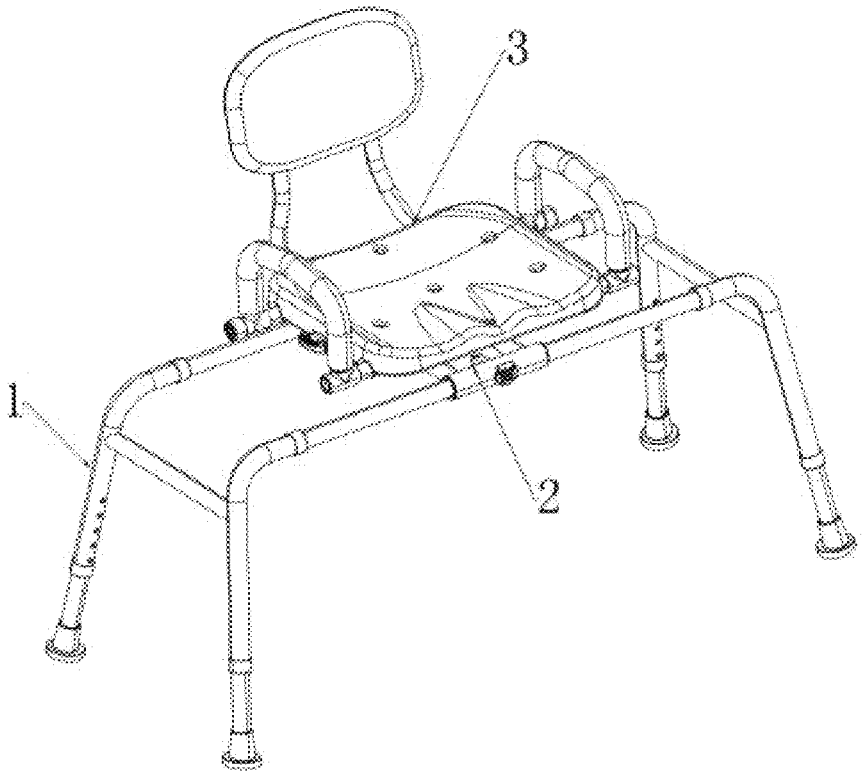
FIG. 1 is a first perspective schematic diagram of the invention.
Figure 3:
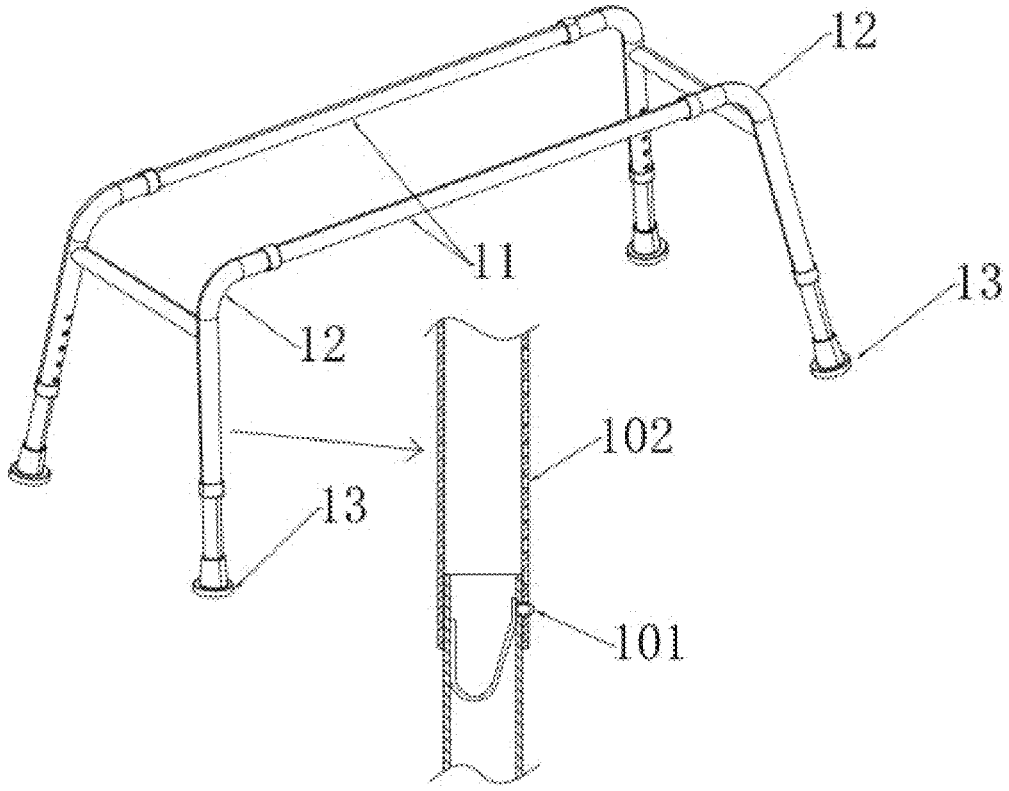
FIG. 3 is a schematic diagram of the support frame according to the invention.

As shown in FIG. 1, a bath chair, comprising support frames 1, a sliding component 2, and a seat component 3;

as shown in FIG. 3, the support frame comprises support crossbars 11, and both ends of the support crossbar on the support frame are provided with height adjustment devices;

the number of the support crossbars 11 is two and they are parallel to each other; both ends of each support crossbar 11 are connected to telescopic pieces through support elbows; a bottom end of the telescopic piece is provided with a supporting foot pad 13; the telescopic piece comprises an inner tube and an outer tube, and an elastic adjustment piece 101 is provided between the inner tube and the outer tube; the outer tube is provided with a plurality of adjustment holes 102; the height position of the sitting posture is adjusted by the telescopic piece.

Figure 4:
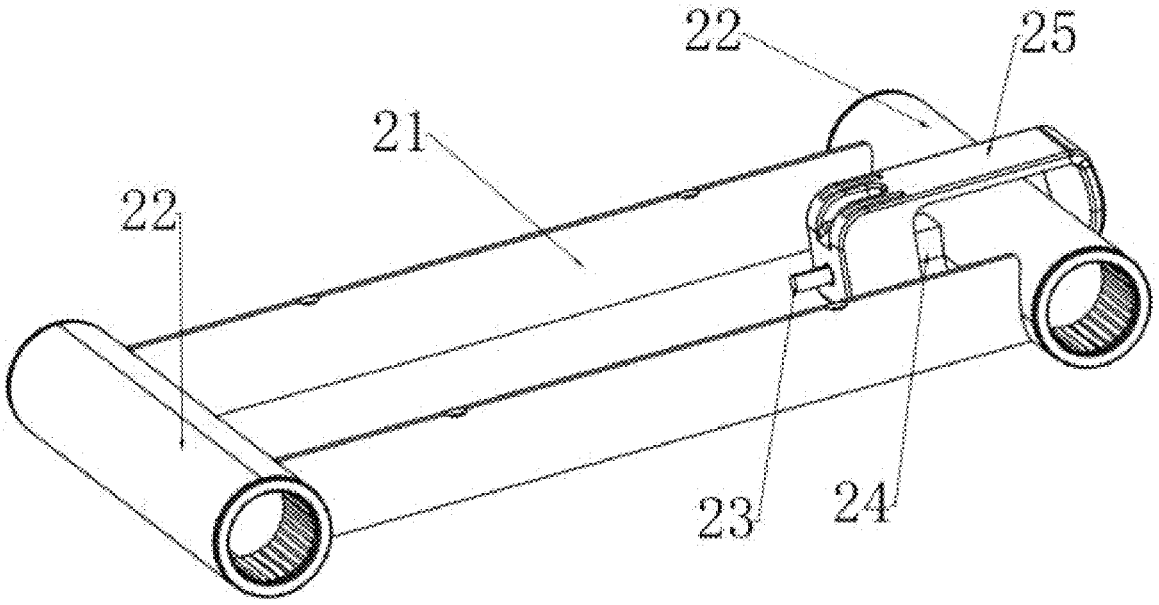
FIG. 4 is a schematic diagram of the combination of the sliding component according to the invention.
Figure 5:
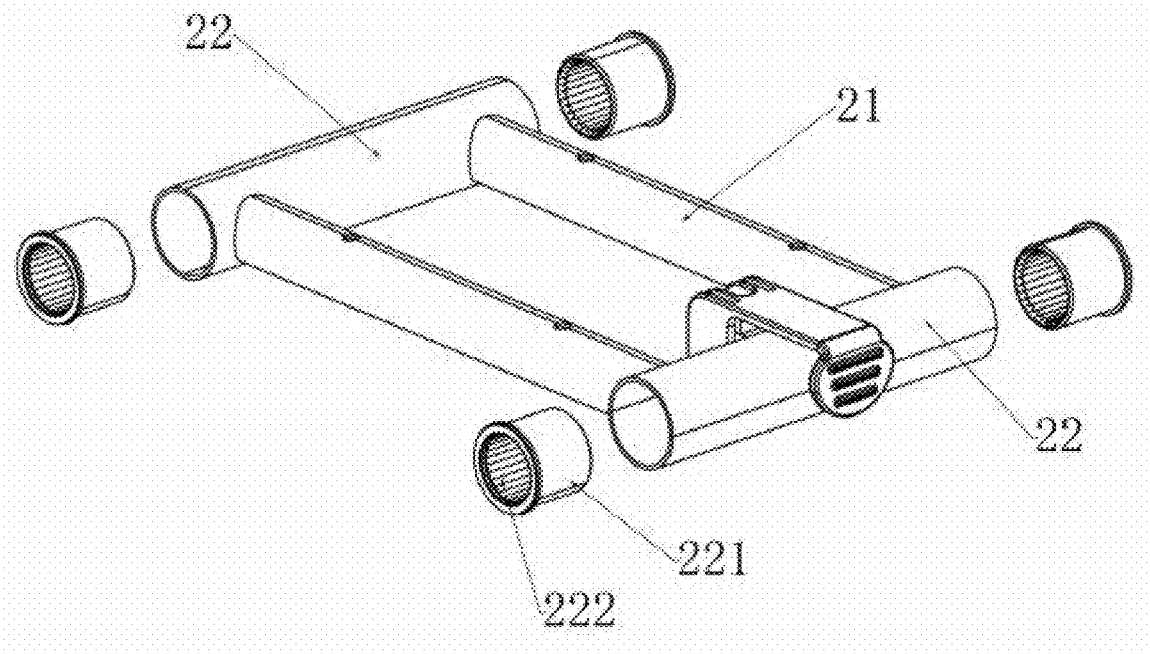
FIG. 5 is an exploded schematic diagram of the sliding component according to the invention.
Figure 6:
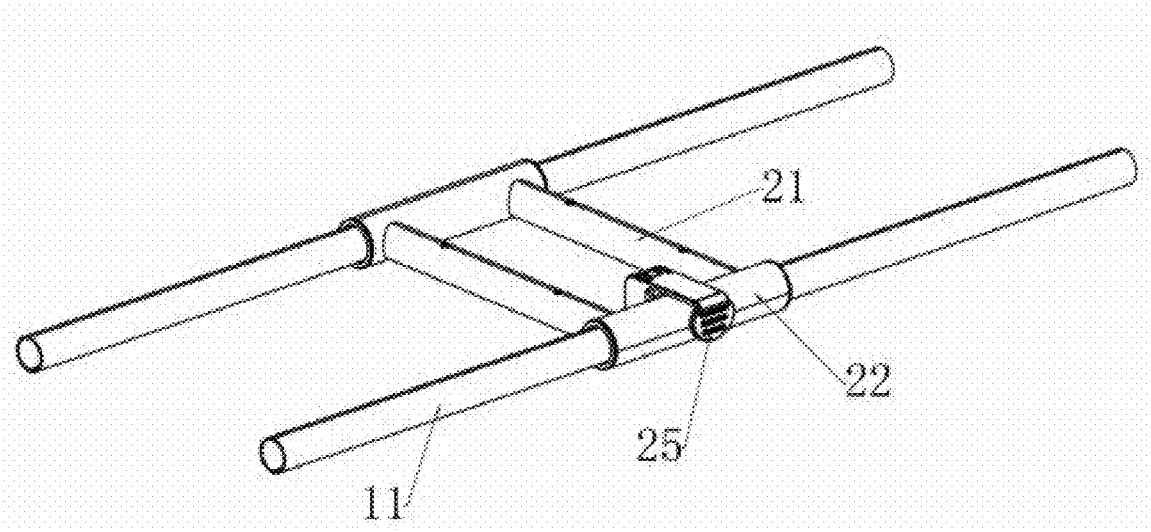
FIG. 6 is a schematic diagram of the connection between the sliding component and the support crossbar according to the invention.

As shown in FIGS. 4-6, the sliding component 2 comprises sliding frames 21 and sleeve pieces 22 arranged on the sliding frames 21, and the sleeve pieces 22 are sleeved on the support crossbars 11 of the support frames 1;

the sliding component 2 further comprises a locking latch 23, a locking guide block 24, and a locking pusher 25; the locking guide block 24 is connected to an outer wall of the sleeve piece 22, and a middle of the locking guide block 24 is provided with a locking guide hole; the locking latch 23 can pass through the locking guide hole and the sleeve piece 22 and be inserted into the support crossbar 11; the support crossbar 11 may be provided with a plurality of holes for inserting the locking latch 23; the locking pusher 25 is connected to the locking latch 23, and the locking pusher 25 controls the locking latch 23 to move in and out of the support crossbar 11;

the seat component is connected to the support frame through a sliding component, so that the horizontal position of the seat component can be adjusted left and right. The user can adjust the position of the bath chair according to actual conditions, which is more convenient to use;

in some embodiments, the sleeve piece 22 is tubular, with sliding sleeves 221 provided at both ends, and a sliding protrusion 222 is provided inside the sliding sleeve 221; the sliding protrusion 222 is used to assist sliding.

Figure 7:
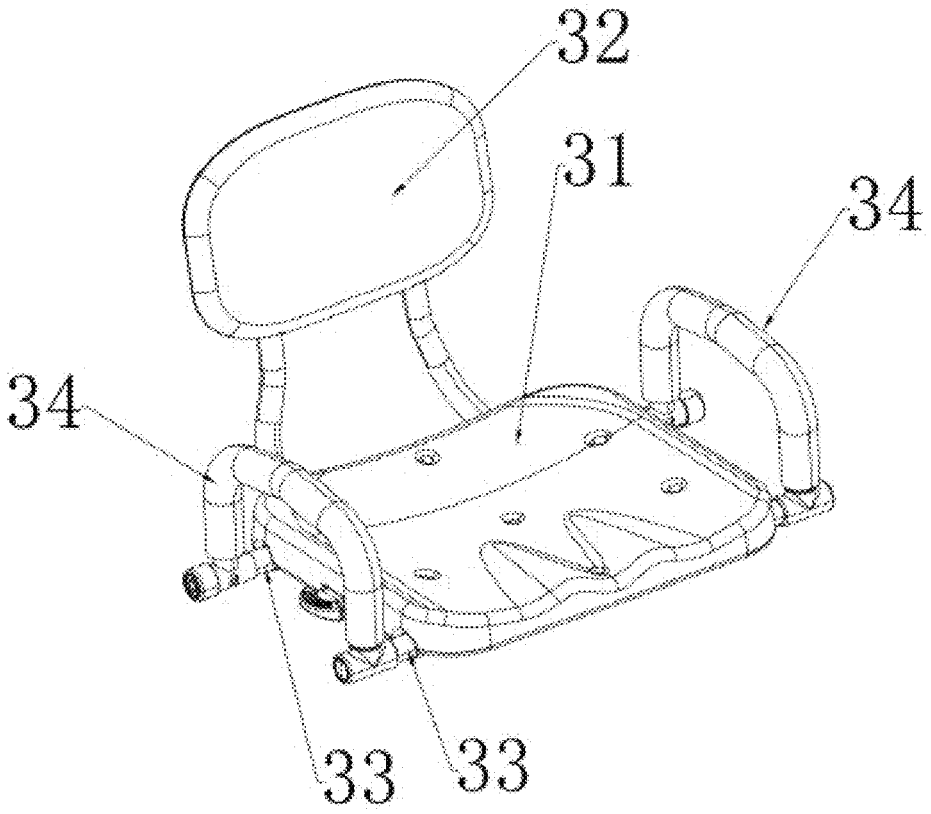
FIG. 7 is a schematic diagram of the seat component according to the invention.
Figure 8:
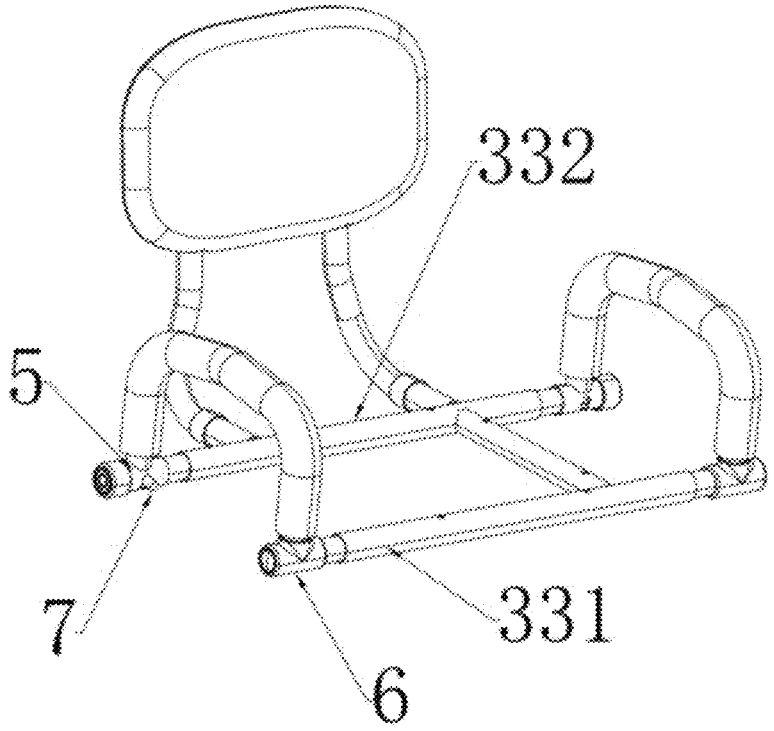
FIG. 8 is a schematic diagram of the skeleton of the seat component according to the invention.
Figure 9:
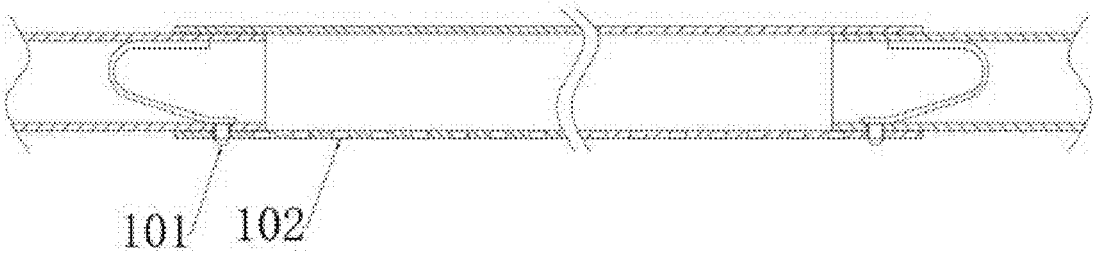
FIG. 9 is a schematic cross-sectional view of the first seat tube or the second seat tube of the seat component according to the invention.
Figure 10:
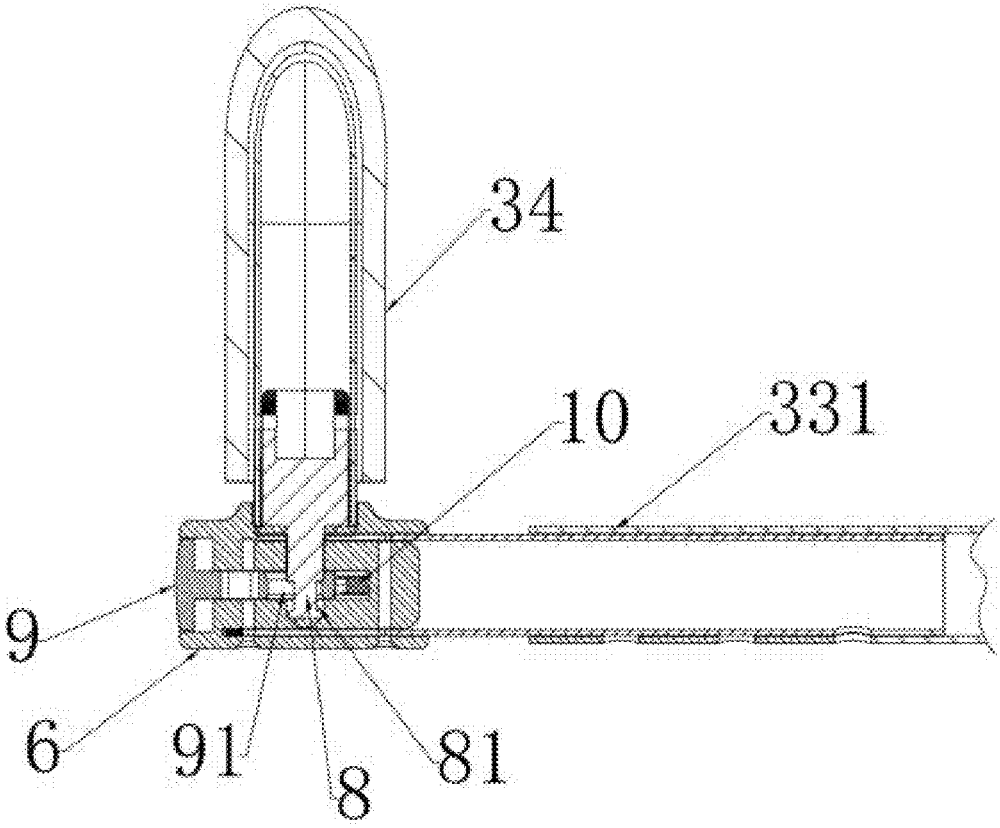
FIG. 10 is a schematic cross-sectional view of the connection between the armrest, the fixing sleeve, and the first seat tube according to the invention.
Figure 11:
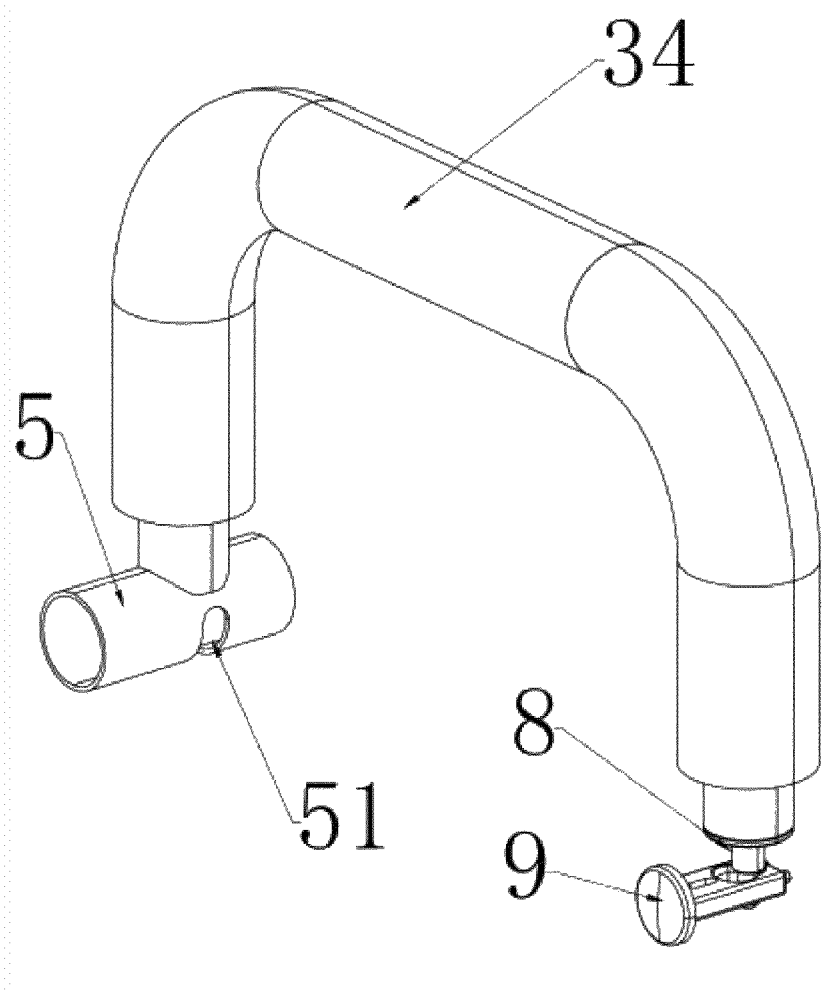
FIG. 11 is a schematic diagram of the end structure of the armrest according to the invention.
Figure 12:
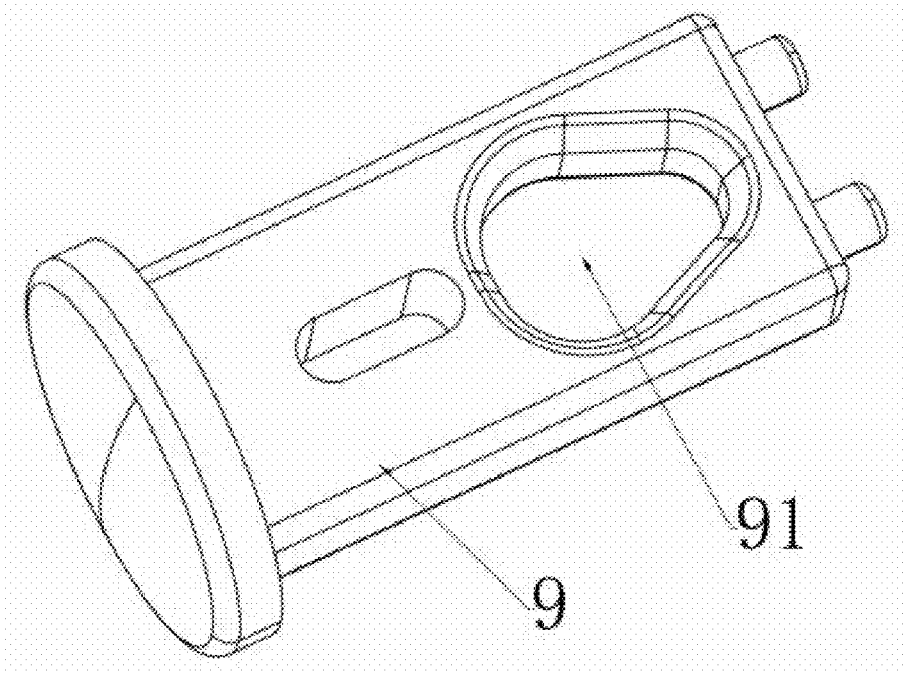
FIG. 12 is a schematic diagram of the locking piece according to the invention.

As shown in FIGS. 1 and 7-12, the seat component 3 moves on the support frames 1 via the sliding component 2;

as shown in FIG. 7, the seat component 3 comprises a seat plate 31, a backrest 32, seat frame tubes 33, and armrests 34; the seat frame tubes 33 are arranged at a bottom of the seat plate 31, and the armrests 34 are arranged on both sides of the seat plate 31 and mounted on the seat frame tubes 33;

the seat frame tubes 33 and the rotating component 4 are arranged on the sliding component 2;

the seat tube frame 33 comprises a first seat tube 331 and a second seat tube 332; both ends of the first seat tube 331 are provided with fixing sleeves 6, and both ends of the second seat tube 332 are provided with rotatable rotating sleeves 5; one end of the armrest 34 is connected to the rotating sleeve 5, and the other end thereof is detachably connected to the fixing sleeve 6; a lower part of the rotating sleeve 5 is provided with a limiting hole 51, and the second seat tube 332 is provided with a limiting column 7 passing through the limiting hole 51; the length of the limiting hole 51 is half of the circumference of the rotating sleeve 5; a locking buckle 8, a locking piece 9, and an elastic piece 10 are provided between the armrest 34, the first seat tube 331, and the fixing sleeve 6; the locking piece 9 is inserted into the first seat tube 331 along the axial direction of the first seat tube 331 and is movably connected to the first seat tube 331 via the elastic piece 10; the locking piece 9 is provided with a locking hole 91, and an inner diameter of the locking hole 91 gradually decreases along the axial direction of the first seat tube 331; the locking buckle 8 is arranged at a bottom of the connection end between the armrest 34 and the fixing sleeve 6, and the locking buckle 8 can pass through a large inner diameter end of the locking hole 91 and be clamped to a small inner diameter end of the locking hole 91; the locking buckle 8 is provided with a locking groove 81, and the locking groove 81 is clamped to an edge of the locking hole 91 close to the seat plate 31; one end of the armrest 34 is rotatably connected to the second seat tube 332 through a rotating sleeve 5, and the other end thereof is detachably connected to the fixing sleeve 6, so that the armrest 34 can be opened and turned over;

both ends of the first seat tube 331 and the second seat tube 332 adopt telescopic piece structures to achieve a telescopic design; the telescopic piece comprises an inner tube and an outer tube, and an elastic adjustment piece 101 is provided between the inner tube and the outer tube; the outer tube is provided with a plurality of adjustment holes 102, which can adjust the distance between the two armrests.

Figure 2:
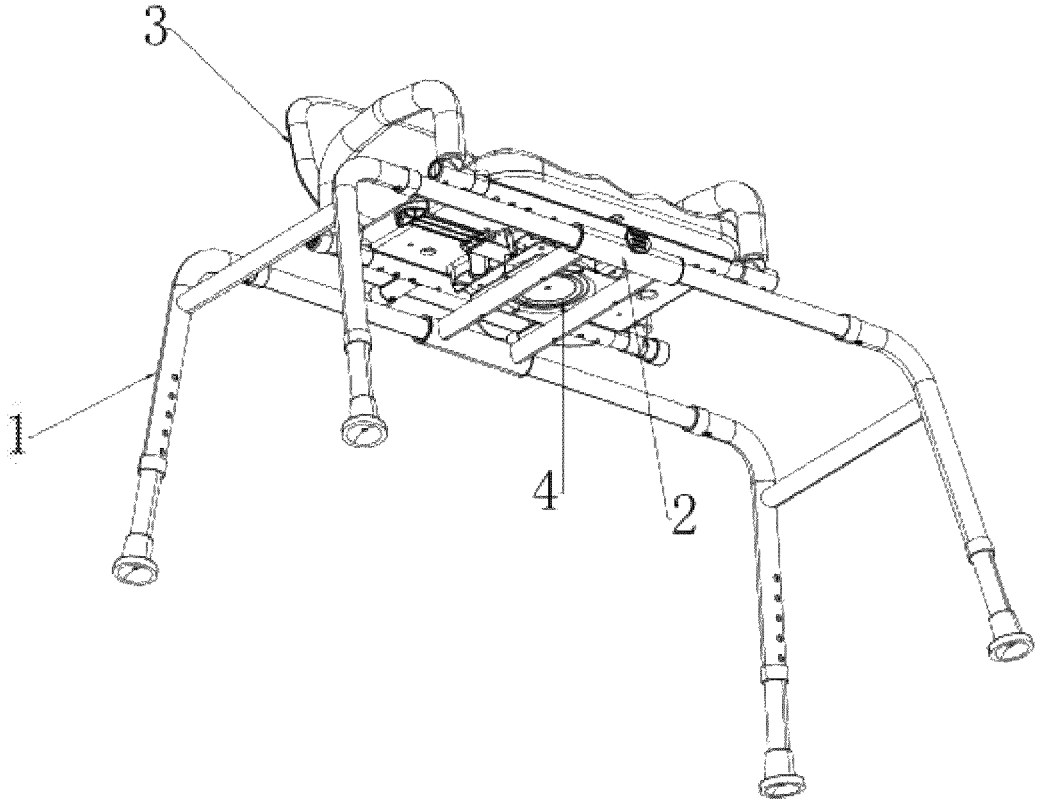
FIG. 2 is a second perspective schematic diagram of the invention.
Figure 13:
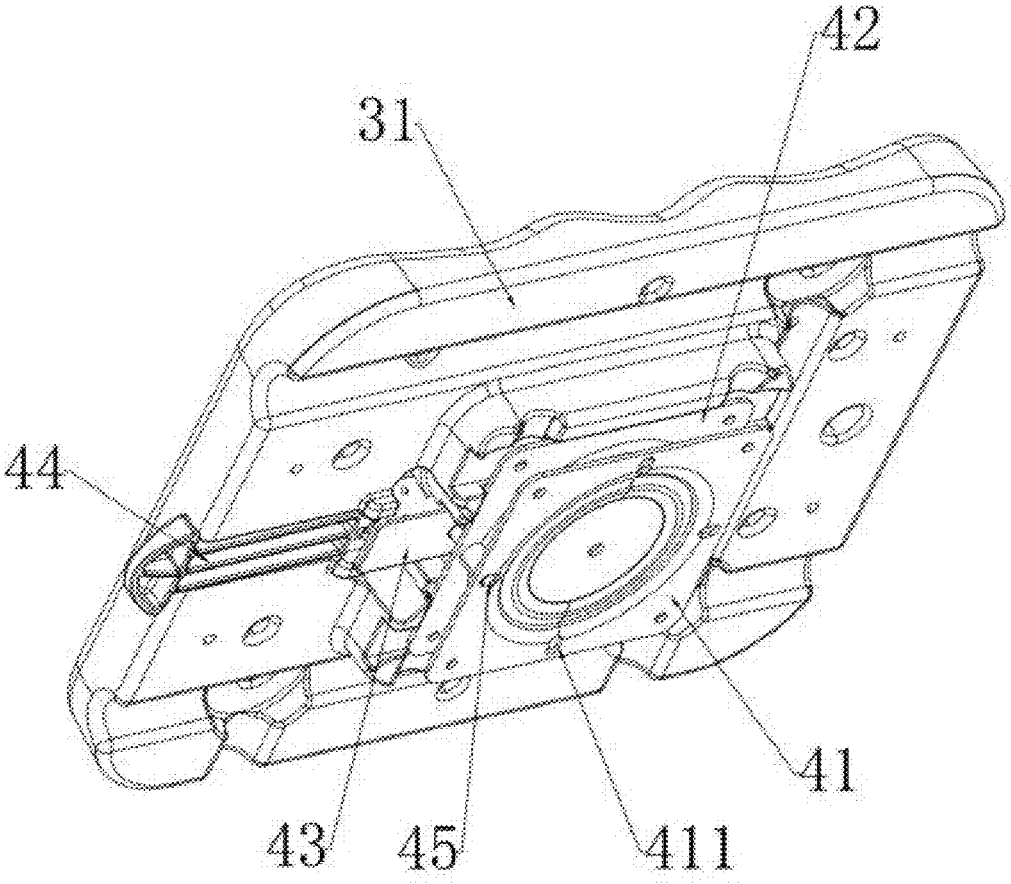
FIG. 13 is a schematic diagram of the rotating component according to the invention.
Figure 14:
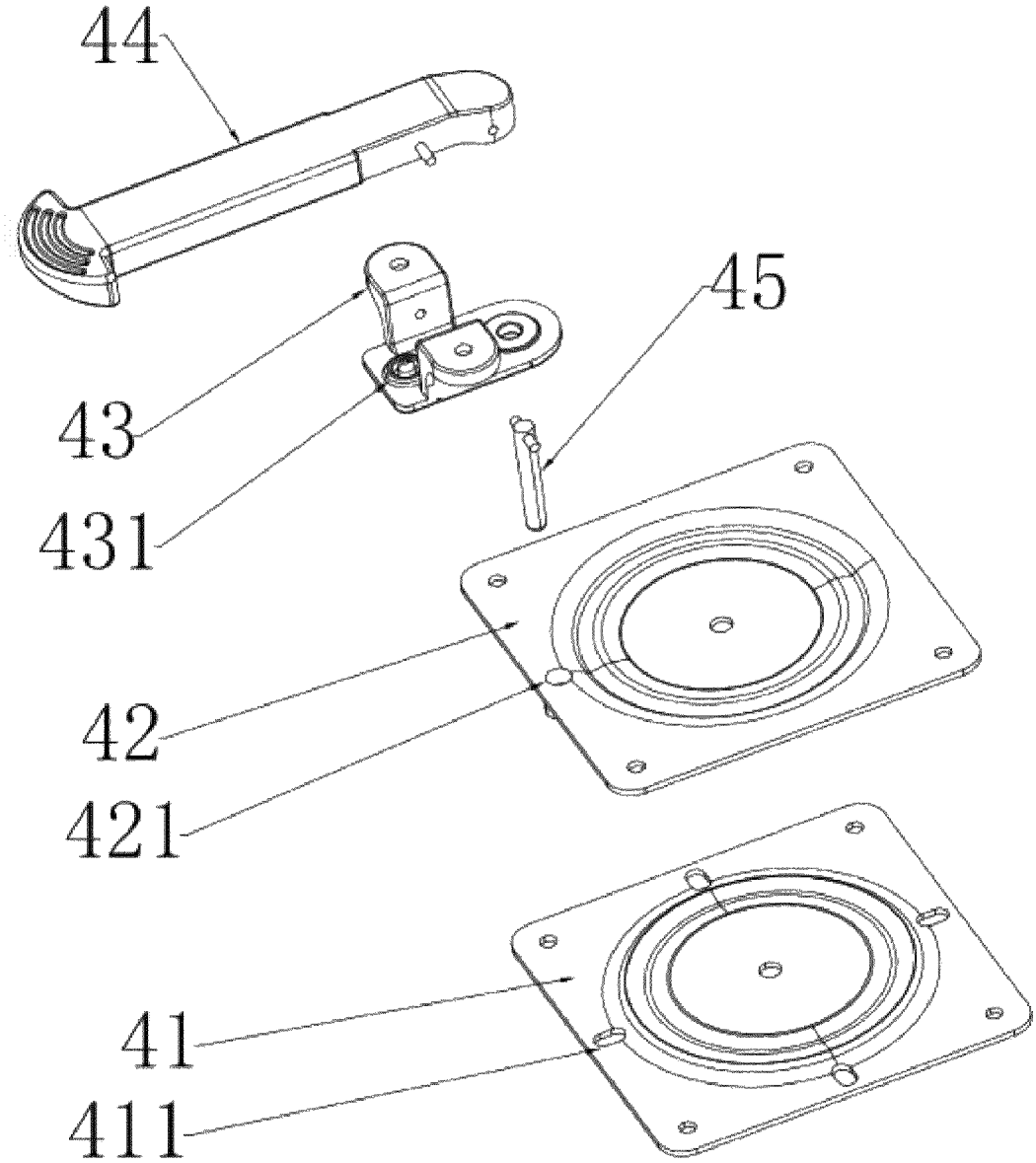
FIG. 14 is an exploded schematic diagram of the rotating component according to the invention.

As shown in FIGS. 2 and 13-14, a rotating component 4 is provided between the seat component 3 and the sliding component 2, so that the function of adjusting the direction of the seat component can be realized; the user can adjust the direction of the bath chair according to actual conditions, which is more convenient to use;

the rotating component 4 comprises a first rotating disk 41, a second rotating disk 42, and a plurality of rotating balls; the first rotating disk 41 is connected to the sliding frames 21, and the second rotating disk 42 is connected to the seat component 3; an upper surface of the first rotating disk 41 and a lower surface of the second rotating disk 42 are both provided with ball grooves, and a plurality of the rotating balls are arranged in the ball grooves; the first rotating disk 41 and the second rotating disk 42 rotate relative to each other via the rotating balls.

the rotating component 4 further comprises a locking seat 43, a locking handle 44, a locking column 45, and a locking elastic piece; the locking seat 43 is connected to the seat component 3, and the locking handle 44 is connected to the locking seat 43 in an up-and-down rotational manner; the first rotating disk 41 is provided with a plurality of first locking positioning holes 411, and the plurality of first locking positioning holes 411 are distributed at intervals along the circumference of the first rotating disk 41; the second rotating disk 42 is provided with a second locking positioning hole 421; the locking handle 44 is hinged to the locking column 45; one end of the locking elastic piece is connected to the locking seat 43, and the other end thereof is used to drive the locking handle 44 to rotate, so as to drive the locking column 45 to pass through the second locking positioning hole 421 and be inserted into one of the first locking positioning holes 411; gaps are left between the locking column 45 and the locking seat 43, between the locking column 45 and the first locking positioning hole 411, and between the locking column 45 and the second locking positioning hole 421;

in some embodiments, the number of the first locking positioning holes 411 is multiple, such as four, and the four first locking positioning holes 411 are distributed at intervals along the circumference of the first rotating disk 41, so that the seat component 3 can achieve multiple orientation changes, which is more convenient to use;

in some embodiments, the locking seat 43 is connected to a bottom of the seat plate 31 by bolts, and the locking handle 44 is rotatably connected to the locking seat 43 by a rotating shaft; when the seat component 3 faces forward, the locking handle 44 is located on the left side of the second rotating disk 42, and the right side of the locking handle 44 is hinged to the locking column 45; the locking elastic piece is a spring; the locking seat 43 is provided with an accommodating groove 431 for placing the spring, and a middle of the accommodating groove 431 is provided with a protrusion, in which the spring can be placed more stably be prevented from deflecting; the spring is located on the left side of the rotating shaft; according to the lever principle, the compressed spring can drive the locking handle 44 to rotate clockwise to the right, thereby driving the locking column 45 to move downward, driving the locking column 45 to pass through the second locking positioning hole 421 and be inserted into one of the first locking positioning holes 411, thereby completing the fixing of the seat component 3, and the fixing effect is better; when the direction needs to be adjusted, the left end of the locking handle 44 is pressed; according to the lever principle, the locking handle 44 drives the locking column 45 to leave the first locking positioning hole 411; at this time, the second rotating disk 42 can rotate relative to the first rotating disk 41, so that the direction can be adjusted, which is faster and more convenient;

in some embodiments, the locking handle 44 and the locking pusher 25 are both provided with anti-slip textures, making the operation more convenient.

The invention and the embodiments thereof are described hereinabove, and this description is not restrictive. What is shown in the drawings is only one of the embodiments of the invention, and the actual structure is not limited thereto. All in all, structural methods and embodiments similar to the technical solution without deviating from the purpose of the invention made by those of ordinary skill in the art without creative design shall all fall within the protection scope of the invention.

The invention claimed is:

1. A bath chair, comprising:

support frames which comprise support crossbars;

a sliding component which comprises sliding frames and sleeve pieces arranged on the sliding frames, and the sleeve pieces are sleeved on the support crossbars of the support frames;

a seat component, which moves on the support frames via the sliding component;

wherein it further comprises a rotating component provided between the sliding component and the seat component, and the rotating component comprises a first rotating disk, a second rotating disk, and a plurality of rotating balls; the first rotating disk is connected to the sliding frames, and the second rotating disk is connected to the seat component; an upper surface of the first rotating disk and a lower surface of the second rotating disk are both provided with ball grooves, and a plurality of the rotating balls are arranged in the ball grooves; the first rotating disk and the second rotating disk rotate relative to each other via the rotating balls.

2. The bath chair of claim 1, wherein both ends of the support crossbar on the support frame are provided with height adjustment devices.

3. The bath chair of claim 1, wherein the sliding component further comprises a locking latch, a locking guide block, and a locking pusher; the locking guide block is connected to an outer wall of the sleeve piece, and a middle of the locking guide block is provided with a locking guide hole; the locking latch can pass through the locking guide hole and the sleeve piece and be inserted into the support crossbar, and the locking pusher is connected to the locking latch.

4. The bath chair of claim 1, wherein the seat component comprises a seat plate, a backrest, seat frame tubes, and armrests; the seat frame tubes are arranged at a bottom of the seat plate, and the armrests are arranged on both sides of the seat plate and mounted on the seat frame tubes; the seat frame tubes are arranged on the sliding component.

5. The bath chair of claim 1, wherein the rotating component further comprises a locking seat, a locking handle, a locking column, and a locking elastic piece; the locking seat is connected to the seat component, and the locking handle is connected to the locking seat in an up-and-down rotational manner; the first rotating disk is provided with a plurality of first locking positioning holes, and the plurality of first locking positioning holes are distributed at intervals along the circumference of the first rotating disk; the second rotating disk is provided with a second locking positioning hole; the locking handle is connected to the locking column; one end of the locking elastic piece is connected to the locking seat, and the other end thereof is used to drive the locking handle to rotate, so as to drive the locking column to pass through the second locking positioning hole and be inserted into one of the first locking positioning holes.

6. The bath chair of claim 4, wherein the seat tube frame comprises a first seat tube and a second seat tube; both ends of the first seat tube are provided with fixing sleeves, and both ends of the second seat tube are provided with rotatable rotating sleeves; one end of the armrest is connected to the rotating sleeve, and the other end thereof is detachably connected to the fixing sleeve; a lower part of the rotating sleeve is provided with a limiting hole, and the second seat tube is provided with a limiting column passing through the limiting hole.

7. The bath chair of claim 6, wherein a locking buckle, a locking piece, and an elastic piece are provided between the armrest, the first seat tube, and the fixing sleeve; the locking piece is inserted into the first seat tube along the axial direction of the first seat tube and is movably connected to the first seat tube via the elastic piece; the locking piece is provided with a locking hole, and an inner diameter of the locking hole gradually decreases along the axial direction of the first seat tube;

the locking buckle is arranged at a bottom of the connection end between the armrest and the fixing sleeve, and the locking buckle can pass through a large inner diameter end of the locking hole and be clamped to a small inner diameter end of the locking hole.

8. The bath chair of claim 1, wherein the sleeve piece is tubular, with sliding sleeves provided at both ends, and a sliding protrusion is provided inside the sliding sleeve.

9. The bath chair of claim 2, wherein the number of the support crossbars is two and they are parallel to each other; both ends of each support crossbar are connected to telescopic pieces through support elbows so that the height can be adjusted according to the height of the user; a bottom end of the telescopic piece is provided with a supporting foot pad.

10. The bath chair of claim 7, wherein both ends of the first seat tube and the second seat tube adopt telescopic piece structures to achieve a telescopic design, so as to facilitate different users.

11. The bath chair of claim 9 or 10, wherein the telescopic piece comprises an inner tube and an outer tube, and an elastic adjustment piece is provided between the inner tube and the outer tube; the outer tube is provided with a plurality of adjustment holes.

12. The bath chair of claim 6, wherein the locking hole is in a water drop shape; the locking buckle is provided with a locking groove, and the locking groove is clamped to an end of the locking hole close to the seat plate.

* * * * *